US008808056B2

(12) United States Patent
Murphy et al.

(10) Patent No.: US 8,808,056 B2
(45) **Date of Patent: *Aug. 19, 2014**

(54) BRASSIERE WITH INTERCHANGEABLE MODESTY PANEL

(76) Inventors: Janet Denice Murphy, Pasadena, CA (US); Joel Michael Murphy, Pasadena, CA (US)

( * ) Notice: Subject to any disclaimer, the term of this patent is extended or adjusted under 35 U.S.C. 154(b) by 93 days.

This patent is subject to a terminal disclaimer.

(21) Appl. No.: 13/465,804

(22) Filed: May 7, 2012

(65) Prior Publication Data

US 2012/0220191 A1 Aug. 30, 2012

Related U.S. Application Data

(63) Continuation-in-part of application No. 12/368,608, filed on Feb. 10, 2009, now Pat. No. 8,241,088.

(51) Int. Cl.
*A41C 3/08* (2006.01)
*A41C 3/00* (2006.01)

(52) U.S. Cl.
CPC ..... *A41C 3/08* (2013.01)
USPC ..... 450/30; 450/1; 450/33

(58) Field of Classification Search
USPC ..... 450/1, 30–35, 63, 70–74, 77–80, 82, 450/86–88, 92, 93, 36, 37, 54–57; 2/102–106, 109, 110, 113, 114, 118, 2/119, 67, 122, 129, 133, 46, 50–54
See application file for complete search history.

(56) References Cited

U.S. PATENT DOCUMENTS

| | | | | |
|---|---|---|---|---|
| 2,567,524 | A * | 9/1951 | Morganti | 2/48 |
| 2,700,767 | A * | 2/1955 | Groocock et al. | 450/30 |
| 2,707,786 | A * | 5/1955 | Stoner | 2/119 |
| 3,064,265 | A * | 11/1962 | Bridgewaters | 2/74 |
| 6,205,585 | B1 * | 3/2001 | Capparelli | 2/106 |
| 6,285,585 | B1 | 9/2001 | Kurihara | |
| 6,935,921 | B1 * | 8/2005 | Eudenbach et al. | 450/54 |

(Continued)

FOREIGN PATENT DOCUMENTS

JP 2006347409 7/2008

OTHER PUBLICATIONS http://www.chicpeeks.com/ (downloaded Jun. 22, 2010).

(Continued)

*Primary Examiner* — Gloria Hale
(74) *Attorney, Agent, or Firm* — Lawrence Lambelet

(57) ABSTRACT

Disclosed is a brassiere that is adjustable for varying levels of modesty or daring. The brassiere includes a modesty panel that is integrated to the design of the brassiere, but is also interchangeable with other modesty panels. The modesty panel can be selected from among a set of modesty panels. In this manner, a wearer may vary the look of an outfit or ensemble by using modesty panels of varying colors, fabrics, textures, or levels of modesty or daring. In various embodiments, the modesty panel is fastened to the brassiere using traditional hook and loop fasteners. In other various embodiments, the to modesty panel may be fastened using hook material and corresponding loop material, or may be fastened using buttons or snap fasteners. Any other manner of fastening systems may be used to render the modesty panel combined with the brassiere as a single article of clothing.

20 Claims, 8 Drawing Sheets

(56) References Cited

U.S. PATENT DOCUMENTS

| | | | | |
|---|---|---|---|---|
| 7,409,728 | B2 * | 8/2008 | Harry | 2/106 |
| 7,780,502 | B2 * | 8/2010 | Calamari et al. | 450/86 |
| 8,241,088 | B2 * | 8/2012 | Murphy et al. | 450/30 |
| 2007/0281585 | A1 * | 12/2007 | Calamari et al. | 450/1 |
| 2009/0093189 | A1 * | 4/2009 | Frey | 450/1 |

OTHER PUBLICATIONS http://www.camisecret.com/Default.asp?bhcp=1 (captured Jun. 10, 2010).

International Search report for PCT application PCT/US10/23528 filed on Feb. 9, 2010, with search report published on Sep. 15, 2010.

* cited by examiner

BRASSIERE WITH INTERCHANGEABLE MODESTY PANEL

CROSS-REFERENCE TO RELATED APPLICATIONS

This is a Continuation In Part Application claiming priority under 35 U.S.C. 120 to U.S. patent application Ser. No. 12/368,608 filed Feb. 10, 2009, now issued as U.S. Pat. No. 8,241,088.

FIELD OF THE INVENTION

The present application relates to an undergarment, and more particularly to a brassiere.

BACKGROUND OF THE INVENTION

Clothing choices for modern women span an array of garments, in many different styles. Among available garments are blouses, tank tops, T-shirts, camisoles, and other tops, which afford various styles of necklines. These choices enable women to achieve various "looks" in their attire. Typically, for example, female attire may include a blouse. The blouse may have a button front or may be a V-neck blouse where the garment does not have buttons. In either instance, a certain amount of cleavage may show unless in some cases an undergarment is worn, such as a camisole which conceals the cleavage and very likely in many instances also conceals the woman's brassiere. In some circumstances a particular amount of cleavage may be appropriate to show, while in other circumstances more or less cleavage may generally be appropriate.

For example, nowadays many women have employment outside the home. They may have professional jobs or other positions where standards of dress require a particular level of modesty or workplace decorum. For this reason, a woman may wear a camisole or other type of garment under a blouse to help conceal the woman's cleavage and/or brassiere. In this way, standards of workplace decorum as to professional dress can be met.

After work, however, a woman may decide that the professional dress appropriate for work can impede recreational activities, or may not be appropriate when going out with friends, or going out to, for example, a nightclub. In this case, it may be necessary to change one's clothes, to take off one's blouse and remove the camisole, for example, or even to change one's blouse entirely. It can be inconvenient, however, to need to change clothing when one goes from a workplace environment to a recreational environment or an entertainment venue after work, for example, where different levels of cleavage exposure may be appropriate. A couple of approaches to addressing the need to change clothing have been devised.

A brassiere which provides cleavage coverage is described in U.S. Pat. No. 6,935,921, "Prosthetic Brassiere," issued Aug. 30, 2005 to Kimberly Eudenbach and Sandra L. Busook. This patent discloses a prosthetic brassiere suitable for use by mastectomy patients, including brassiere cups that are adapted to hold prosthetic breasts. The prosthetic brassiere of Eudenbach and Busook also includes a privacy panel that attaches to the prosthetic brassiere to conceal the prosthetic breast and/or scars from surgery. Because the brassiere cups are adapted to hold prosthetic breasts, each includes material to define a pocket into which a prosthetic breast may be inserted. The privacy panel attaches to upper portions of the prosthetic brassiere cups.

Another approach for providing cleavage coverage is described by Patricia A. Calimari and Karla A. Kennedy, in U.S. Patent Application Publication No. 2007/0281585, "Partial Undergarment And Method For Covering A Woman's Exposed Cleavage," published Dec. 6, 2007. In this approach, a partial undergarment for covering a woman's exposed cleavage is provided. The partial undergarment attaches to the straps of the woman's brassiere, with another portion of the partial undergarment wrapped around the brassiere itself. The partial undergarment does not provide for different levels of cleavage coverage, and may look bulky under the wearer's clothing due to its means of attachment. In addition, there may be a need to remove an outer garment in order to be able to remove the partial undergarment.

Neither of the two prior art approaches are completely satisfactory. In one case, the approach is directed to wearers of prosthetic breasts, and moreover lacks a secure bottom fastening that a wearer of a lightweight brassiere may desire. In the other case, the method of attachment may be cumbersome and take time to arrange for proper cleavage coverage.

SUMMARY OF THE INVENTION

Disclosed in this application is a brassiere that is adjustable for varying levels of modesty or daring. The brassiere includes a modesty panel that is integrated to the design of the brassiere, but is also interchangeable with other modesty panels. The modesty panel can be selected from among a set of modesty panels. In this manner, a wearer may vary the look of an outfit or ensemble by using modesty panels of varying colors, fabrics, textures, or levels of modesty or daring.

In various embodiments, the modesty panel is fastened to the brassiere using traditional hook and eye fasteners. In various other embodiments, the modesty panel may be fastened through the use of hook and loop fasteners. The loops may be made of for example, wire, thread, or another filamentary material; hook and wire loop fasteners may be referred to as hook and eye fasteners. In still other various embodiments, the modesty panel may be fastened using hook material and corresponding loop material, such as, for example, VELCRO. One or more of the various embodiments may include fastener concealment flaps that insulate the breasts from contact with the hooks, loops, or other fasteners. It will be understood that any other manner of current fastening systems and/or future fastening systems may be used to render the modesty panel combined with the brassiere as a single article of clothing, and are within the scope of this disclosure.

The modesty panel is designed to span a region between a left brassiere cup and a right brassiere cup to provide coverage of a wearer's cleavage. The region spanned by the modesty panel includes at least one point midway between a lower portion of the left brassiere cup and a lower portion of the right brassiere cup, that can be used to provide a securing point for a bottom central portion of the modesty panel. The securing point of the bottom central portion may include a button fastener, a snap fastener, or any other suitable type of fastener.

The modesty panel may be selected from among a set of modesty panels, as mentioned above. The different modesty panels may be distinguished by fabric, texture, and/or color. Moreover, due to the design of the modesty panel and the brassiere in combination, the modesty panel can achieve various levels of modesty or daring. The properties of the brassiere in combination with the modesty panel thus can allow for an adjustment between a workplace or professional type of appearance, and a more casual, less formal mode of attire, for example, more suitable for after work and/or recreational activities. A more daring look may also be more desirable with more fashionable garments intended for evening activities (for example, attendance at concerts or nightclubs).

DETAILED DESCRIPTION OF THE PREFERRED EMBODIMENT

Figure 1:
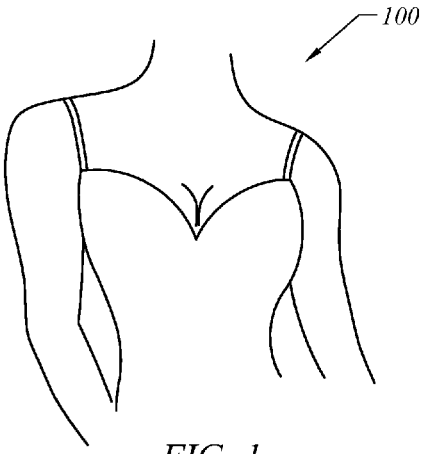
FIG. 1 shows an outer garment without a modesty panel.

Turning now to the drawings, attention is first directed to FIG. 1, which shows an outer garment 100 without a modesty panel. While the outer garment may be fashionable when worn by itself, this garment may not be suitable for a work environment or in a professional setting. In addition, the outer garment may reveal surgery scars or a mastectomy prosthesis if one is worn.

Figure 2:
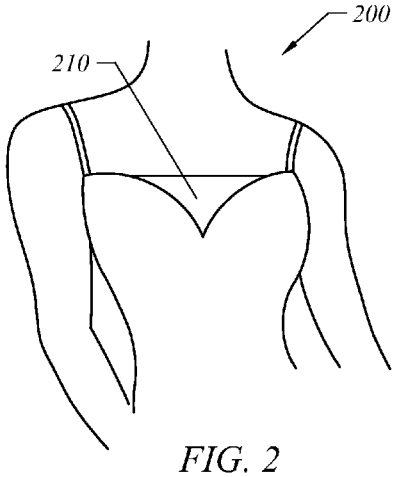
FIG. 2 shows how the outer garment of FIG. 1 may appear if a first level modesty panel according to an embodiment is worn with the outer garment.
Figure 3:
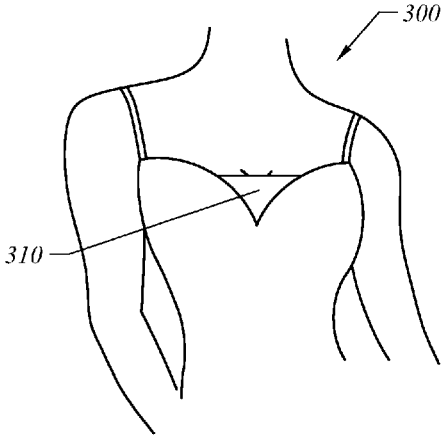
FIG. 3 shows how the outer garment may look when worn with a brassiere including a second level modesty panel according to an embodiment.
Figure 4:
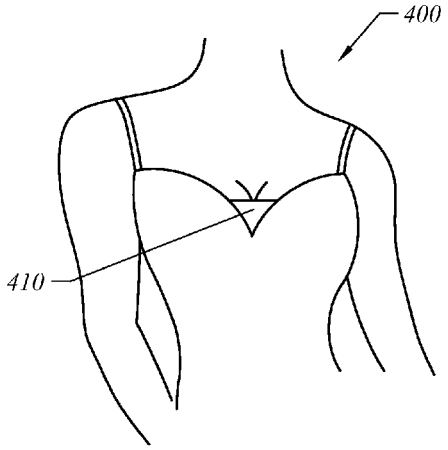
FIG. 4 shows how the outer garment may look with a very low level modesty panel according to an embodiment.

FIGS. 2-4 show successive levels of daring due to use of successively more daring modesty panels 210-410. FIG. 2 shows how the outer garment of FIG. 1 may appear if a first level modesty panel 210 is worn with the outer garment 200. The first level modesty panel 210 would cover substantially all cleavage and give a professional, layered, or covered look. The first level modesty panel 210 is attached close to the highest point of the cups of the brassiere (see FIG. 10, below), and would, for most women, cover all cleavage.

FIG. 3 shows how the outer garment 300 may look when worn with a brassiere including a second level modesty panel 310. The second level modesty panel 310 would cover a portion of the cleavage area. The second level modesty panel 310 would be made for those who want to be sexy and not show very much cleavage and still maintain that professional, layered, or covered look. The second level modesty panel 310 is attached to the cups of the brassiere near the middle section of the brassiere (see FIG. 11, below).

FIG. 4 shows how the outer garment 400 may look with a very low level modesty panel 410. The very low, or third level, modesty panel 410 would typically show some cleavage, as many women may desire, but can also enhance the bosom and give the outer garment 400 a different look. The very low, third level modesty panel 410 is attached to the cups of the brassiere below the middle section of the brassiere (see FIG. 12, below).

In the various embodiments, as described below, all of the modesty panels 210-410 of FIGS. 2-4 can be removed easily, as explained below in connection with FIGS. 7-9. For example, with the first level modesty panel 210 and second level modesty panel 310, if a woman wants to go to a casual setting after work, all she has to do is remove the modesty panel 210 or 310 from the brassiere and the outer garment 100 (see FIG. 1) reveals cleavage that was covered. There would be no need to remove the outer garment 200 or 300 to remove the modesty panel. Moreover, there is no additional "bulk" from another undergarment that might have been worn to conceal the cleavage, or from a need to wrap ends of the modesty panel around the brassiere or its straps. In addition, there is no additional bulk from added material in a brassiere cup to receive a prosthetic breast. As previously mentioned, FIGS. 2-4 show three levels of modesty and/or daring as an example of how an outer garment may look with various levels of modesty panels. It should be understood that there may be any suitable number of modesty levels, for example, two, four, or even five or more modesty levels. Although the combination of a brassiere with a modesty panel is discussed herein in various embodiments with three modesty levels, it will be appreciated that various designs, including more or fewer modesty levels, are within the scope of this disclosure.

Figure 5:
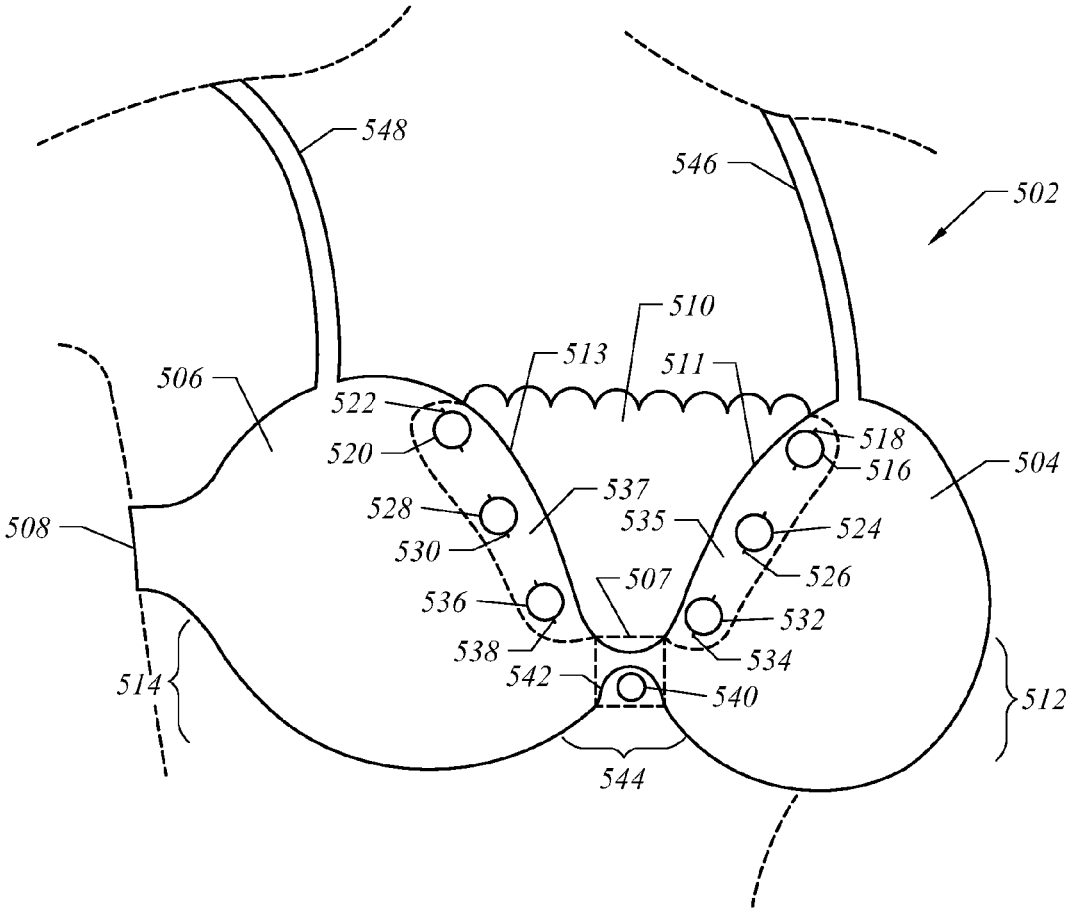
FIG. 5 shows a brassiere including a modesty panel according to an embodiment.

Turning now to a brassiere in combination with a modesty panel, FIG. 5 shows a brassiere 502 including a modesty panel 510 according to an embodiment. The brassiere 502 includes a left brassiere cup 504 and a right brassiere cup 506. It should be understood that the left brassiere cup and the right brassiere cup as shown, are designed and configured to support a left natural breast and a right natural breast, respectively. That is, in general the left brassiere cup does not include a pocket configurable to receive a prosthetic breast; similarly, in general the right brassiere cup does not include a pocket configurable to receive a prosthetic breast. (In various embodiments a brassiere cup of the brassiere may however support a breast prosthesis.) The brassiere 502 also includes a lower central portion 507 between the left brassiere cup 504 and the right brassiere cup 506. The brassiere 502 in addition includes a support band 508 that is coupled with the left brassiere cup 504 and with the right brassiere cup 506, and configured to substantially encircle a torso of a wearer when the brassiere 502 is worn as an undergarment.

The left brassiere cup 504 has an inward edge 511 as shown, and has a lower portion 512. Similarly, the right brassiere cup 506 has an inward edge 513 and a lower portion 514. In the embodiment shown, the modesty panel 510 has a set of attachment areas 516, 520, 524, 528, 532, and 536 in left and right attachment portions 535 and 537, respectively, the attachment areas configured to be removably attached to the brassiere cups adjacent the inward edge 511 of the left brassiere cup 504 and adjacent the inward edge 513 of the right brassiere cup 506. To accomplish attachment of the attachment areas 516, 520, 524, 528, 532, and 536 to the brassiere cups 504 and 506, corresponding fasteners or attachment devices 518, 522, 526, 530, 534, and 538 are disposed adjacent the inward edges 511 and 513 of the brassiere cups, as shown. It is understood that in various embodiments there may be more, or fewer, attachment areas in the left and right attachment portions 535 and 537.

In addition to the attachment areas 516, 520, 524, 528, 532, and 536 in the attachment portions 535 and 537, the modesty panel 510 has a bottom central portion 542. The bottom portion 542 includes a fastening device, for example, a buttonhole, a hook or other fastener (650, see FIG. 6), that can secure the bottom of the modesty panel to the brassiere at at least one point within a region 544 midway between the lower portions 512 and 514 of the left and right brassiere cups, by coupling the modesty panel 510 with the lower central portion 507 of the brassiere. In this manner the brassiere 502 and modesty panel 510 are secured together by a fastening arrangement. For this purpose the brassiere 502 includes a button, a hook (or other appropriate fastening device) 540 located in the region 544 and adapted to mate with the buttonhole, hook or fastener 650, and provides a secure fastening of the bottom of the modesty panel 510, as explained in connection with FIGS. 8 and 9 below.

Besides the button 540, the brassiere 502 also includes a left strap 546 coupled with the upper portion of the left brassiere cup 504 at a first end, and with the support band 508 at a second end of the left strap. Also, the brassiere 502 includes a corresponding right strap 548 that is coupled with the upper portion of the right brassiere cup 506 at a first end, and with the support band 508 at a second end of the right strap. The straps are configured to be worn over respective left and right shoulders, and in this way help to support the brassiere 502 during wear as an undergarment, as shown.

It should be appreciated that the combination of the brassiere 502 and the modesty panel 510 is not limited to the style shown in FIG. 5. That is, the brassiere in combination with the modesty panel can embody different styles, including for example support, push-up, sheer, underwire, strapless, plunge, nursing, mastectomy/prosthetic, sports, and all other types not mentioned. It may also be adapted for use in swimwear. In various embodiments the modesty panel can include at least one of a lace portion, a satin portion, a silk portion, a cotton portion, a polyester portion, or a stretch material portion. Thus, the benefit of a removable modesty panel with a secure bottom fastening (see FIG. 9, below) can be available for wear with many different types of garments, and therefore in different work and/or recreational contexts.

A brassiere including a modesty panel is also suitable for use in children's wear, as a "beginner's bra" or a "training bra," that is, a training brassiere. Young girls may engage in activities requiring particular styles of clothing. For example, some children may participate in ceremonial activities, such as choir, chorale, or school events requiring particular styles of dress. Children of school age range in development from well before puberty, to prepubescence, and through puberty. For some girls, it may be appropriate to wear a "training"-style brassiere with a modesty panel, particularly with ceremonial robes or formal dress that may be low-cut.

Moreover, a girl may desire to wear a training bra incorporating a modesty panel with school wear, for example, with a school uniform. The modesty panel adds a style aspect to the training bra that may be more comfortable or more convenient than wearing, for example, a camisole or t-shirt. The wearing of a training bra with a modesty panel may also be desirable during play activities. It is understood that a training bra incorporating a modesty panel is within the scope of this disclosure.

Figure 6:
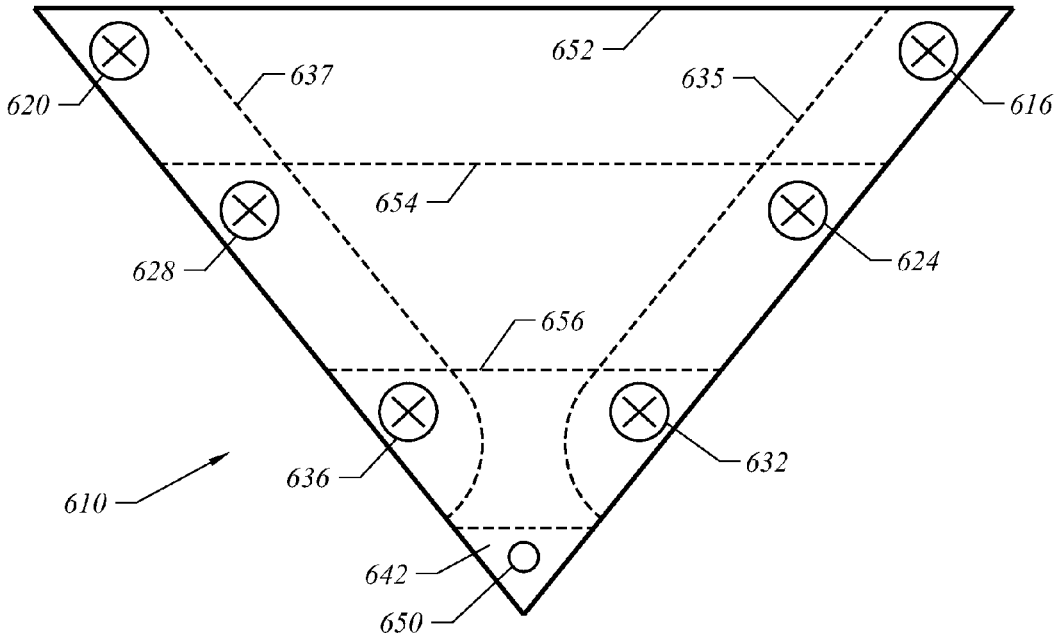
FIG. 6 illustrates an example modesty panel according to an embodiment.

Turning now to the modesty panel itself in more detail, FIG. 6 illustrates an example modesty panel 610 according to an embodiment. The modesty panel 610 is designed to span a region between the left brassiere 504 (see FIG. 5) cup and the right brassiere cup 506 to provide coverage of a wearer's cleavage. As mentioned above, the region spanned by the modesty panel 610 includes at least one point midway between a lower portion of the left brassiere cup and a lower portion of the right brassiere cup, that can be used to provide a securing point for a bottom central portion of the modesty panel 610. The securing point of the bottom central portion may include a button fastener, a hook fastener, a snap fastener, or any other suitable type of fastener, as discussed below.

The modesty panel 610 includes a left attachment portion 635 and a right attachment portion 637. The left attachment portion 635 includes areas of attachment 616, 624, and 632. The areas of attachment 616, 624, and 632 may include for example hooks, buttons, or snap fasteners or even hook material such as for instance VELCRO. Similarly, the right attachment portion 637 includes areas of attachment 620, 628, and 636, and these areas of attachment may also include for instance hooks, buttons, snap fasteners, hook material or similar fastening means. The hooks (or other attachment devices) on the modesty panel mate with corresponding loops (or corresponding mating attachment devices) on the brassiere cups. In this way, the left attachment portion 635 is configured to be removably attached with the set of left hooks on the left attachment portion and the corresponding set of left loops adjacent the inward edge 511 (see FIG. 5) of the left brassiere cup 504. In a similar way, the right attachment portion 637 is configured to be removably attached with the set of right hooks on the right attachment portion and the corresponding set of right loops adjacent the inward edge 513 of the right brassiere cup 506. As discussed above, the loops may be made of wire, thread, or of another filamentary material; a hook and wire loop fastener may also be known as a hook and eye fastener. A bottom central portion 642 may include an attachment area 650 which in various embodiments may define a buttonhole, or in various other embodiments may be a hook fastener or a snap fastener. In various embodiments a loop, for example, of thread, string or elastic cord, may be connected with the bottom central portion 642 to define the attachment area 650 (see FIG. 17, below).

FIG. 6 also shows schematically that there may be a variety of modesty panels, distinguished by their level of daring. The first level modesty panel has an upper boundary or edge denoted at 652. A middle level or second level modesty panel may have an upper edge 654, and thus may include only the attachment areas 624, 628, 632, and 636, as well as the bottom attachment area 650. A very low level modesty panel may have an upper edge 656, and include the attachment areas 632 and 636, as well as the bottom attachment area 650 in the bottom attachment region 642. It is understood that there may be more or fewer attachment areas than the seven areas shown on the modesty panel 610. In particular, there may be two or more bottom attachment areas 650, and there may be four, two, or any suitable number of attachment areas within either of the attachment portions 635 and 637. In this manner the modesty panel 610 can provide a means for concealing at least a portion of a region between the left brassiere cup 504 (see FIG. 5) and the right brassiere cup 506. Also, in this way a modesty panel can provide a particular level of modesty or daring from among a set of modesty levels.

Due to its design, the modesty panel 610 is straightforward to attach to the brassiere 602. FIGS. 7 through 9 show a sequence in which the modesty panel can be attached to the brassiere. For example, in FIG. 7, the brassiere 702 is shown with the modesty panel 710 partially attached. In FIG. 7, the left side of the modesty panel 710 has been attached at attachment points 716, 724, and 732. For example, in an embodiment, hooks 1516, 1524, and 1532 (see FIG. 15, below) may have been inserted into corresponding loops 1318, 1326, and 1334 (see FIG. 13, below). That is, the set of left loops is configured to engage the set of left hooks. Similarly, the set of right loops (not shown) is configured to engage the set of right hooks (not shown). The bottom central portion 742 has not yet been attached, and as shown in FIG. 7, the right side of the modesty panel is ready to be attached to the right brassiere cup 706.

Figure 8:
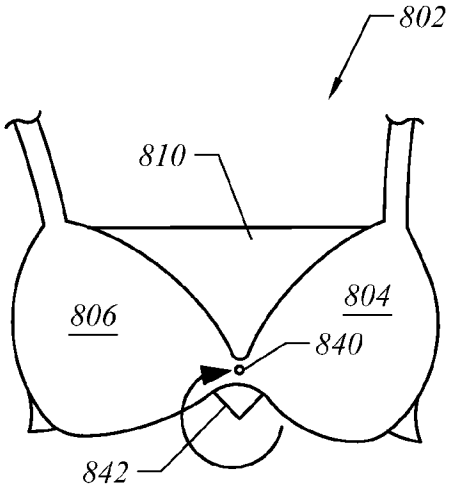
FIG. 8 shows the modesty panel and brassiere of FIG. 7 during a second portion of a sequence of steps for attaching the modesty panel to the brassiere.

FIG. 8 shows the modesty panel 810 after attachment to both the left brassiere cup 804 and to the right brassiere cup 806, but before the attachment of the bottom portion 842 of the modesty panel to the brassiere 802. FIG. 8 shows the brassiere 802 and the modesty panel 810 and also shows that there is a button 840 toward the bottom of the brassiere, in the lower central portion of the brassiere (544, see FIG. 5), and a bottom portion 842 of the modesty panel 810. By pulling down on the bottom portion 842, and then drawing it up in front of the brassiere 802, the button 840 may be inserted into a corresponding buttonhole (1550, see FIG. 15, below) on the modesty panel in the bottom portion 842. It is understood that another fastening device 540 (see FIG. 5) may be used in place of the button 840, with a corresponding fastening device 650 (see FIG. 6) adapted to mate with the fastening device 540 in place of the buttonhole 1550. Typically, but not necessarily, the button 840 or other fastening device 540 is on the front of the brassiere 802 so as not to discomfort the wearer of the brassiere. In various embodiments the fastener may instead be disposed on the inside of the brassiere. In this way the modesty panel 810 is secured or anchored around the lower portion of the brassiere 802 (which includes the lower central portion 507 and the region 544, see FIG. 5), providing a greater level of security to a wearer. For example, with hooks and loops as fastening means, or even with hook material and loop material, the drawing up of the bottom portion 842 around the lower portion of the brassiere 802 helps securely engage the fasteners 516, 518, 520, 522, 524, 526, 528, 530, 532, 534, 536, and 538 (see FIG. 5). It will be appreciated that even with other types of fasteners, for example, buttons and buttonholes, or snap fasteners for 516, 518, 520, 522, 524, 526, 528, 530, 532, 534, 536, and 538, securing the bottom portion 842 provides a benefit to a wearer through additional securing of the modesty panel. It is understood that there may be alternative means of attachment of the bottom portion 842 than through use of a button and buttonhole. For example, a loop in place of the button 840 and a hook on the modesty panel in the bottom portion 842 may be used. For another example, one portion of a snap fastener in place of the button 840 on the brassiere and a corresponding portion of a snap fastener on the modesty panel in the bottom portion 842 may be used also.

Figure 7:
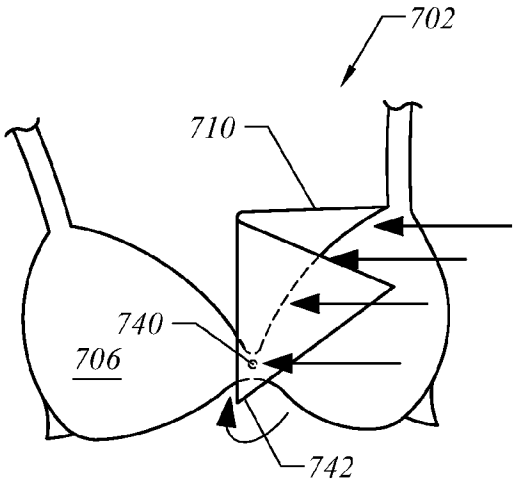
FIG. 7 shows a modesty panel and brassiere according to an embodiment during a portion of a sequence of steps for attaching the modesty panel to the brassiere.
Figure 9:
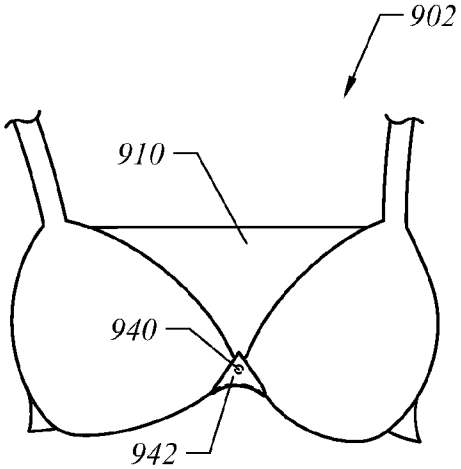
FIG. 9 shows the modesty panel and brassiere of FIGS. 7 and 8 in their final arrangement as an integrated article of clothing.

FIG. 9 shows the modesty panel and brassiere of FIGS. 7 and 8 in their final arrangement as an integrated article of clothing 902. As shown, the bottom portion of the modesty panel is affixed to the brassiere at the attachment point 940, which may include, as previously mentioned, a button, snap fastener, wire hook and loop, or even hook and loop material such as VELCRO, for example. Thus, the sequence of drawings FIGS. 7-9 illustrates how the brassiere/modesty panel combination becomes a single undergarment.

The modesty panel may be removed by reversing the steps taken to attach it. For example, a wearer may first undo the button 940 (see FIG. 9). Next, the bottom portion 942 of the modesty panel 810 may be removed from around the lower portion of the brassiere 902, to bring the modesty panel and brassiere back to the configuration of FIG. 8. Then, one of the sides of the modesty panel 710 (see FIG. 7) may be undone from its attachment to the respective brassiere cup. Finally, the other side of the modesty panel 710 may be undone, and the modesty panel removed. It should be understood that the order of some or all of these steps may be changed. In addition, one side of the modesty panel 710 need not be completely detached before beginning detachment of the other side.

Figure 10:
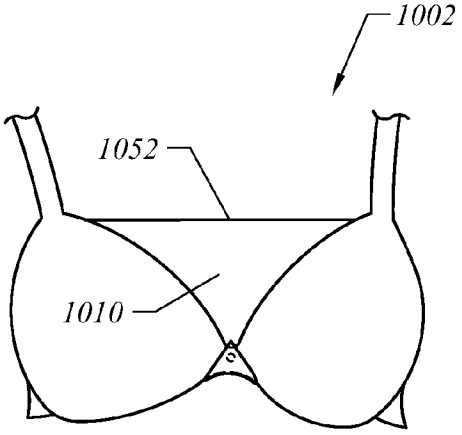
FIG. 10 shows a brassiere with a first level modesty panel according to an embodiment as may be worn with an outer garment corresponding to FIG. 2.

The ease with which a wearer can attach and remove the modesty panel can provide for a variety of levels of modesty that a wearer may choose to display. That is, as discussed above, there can be different levels of modesty or daring that may be arranged, as a wearer may choose. For example, FIGS. 10-12 correspond to FIGS. 2-4, but show only the brassiere, and not the outer garment. FIG. 10 shows a brassiere 1002 with a first level modesty panel 1010 as may be worn with an outer garment 200 corresponding to FIG. 2 with the modesty panel 210. As shown in FIG. 10, the modesty panel has the highest level upper edge 1052.

Figure 11:
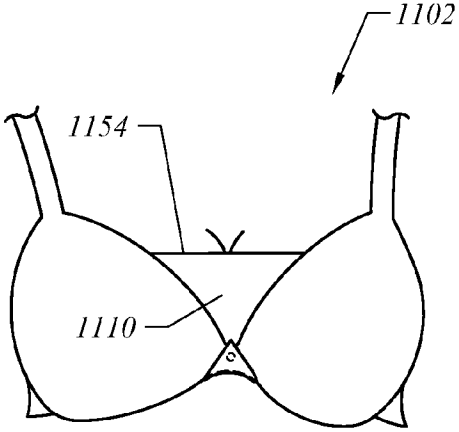
FIG. 11 shows a brassiere with a second level modesty panel according to an embodiment as may be worn with an outer garment corresponding to FIG. 3.
Figure 12:
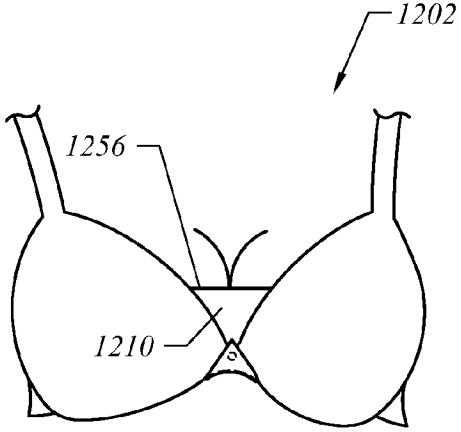
FIG. 12 shows a brassiere with a very low level modesty panel according to an embodiment as may be worn with an outer garment corresponding to FIG. 4.

Turning now to FIG. 11, it corresponds to the outer garment 300 of FIG. 3 with the modesty panel 310. As shown in FIG. 11, the brassiere 1102 includes a second level modesty panel 1110 which has a second level upper edge 1154. Finally, FIG. 12 corresponds to the outer garment 400 of FIG. 4 with a very low level modesty panel 410. As shown in FIG. 12, the brassiere 1202 includes a very low, third level modesty panel 1210 which has the low level upper edge 1256. It will be understood that a wearer may change the look of her attire from that of FIG. 2 to that of FIG. 3 or FIG. 4 by removing the modesty panel 1010 of FIG. 10 and replacing it with the modesty panel 1110 of FIG. 11 or the modesty panel 1210 of FIG. 12. It will further be understood, with reference to FIGS. 7-9, that such changes are straightforward to accomplish.

Figure 13:
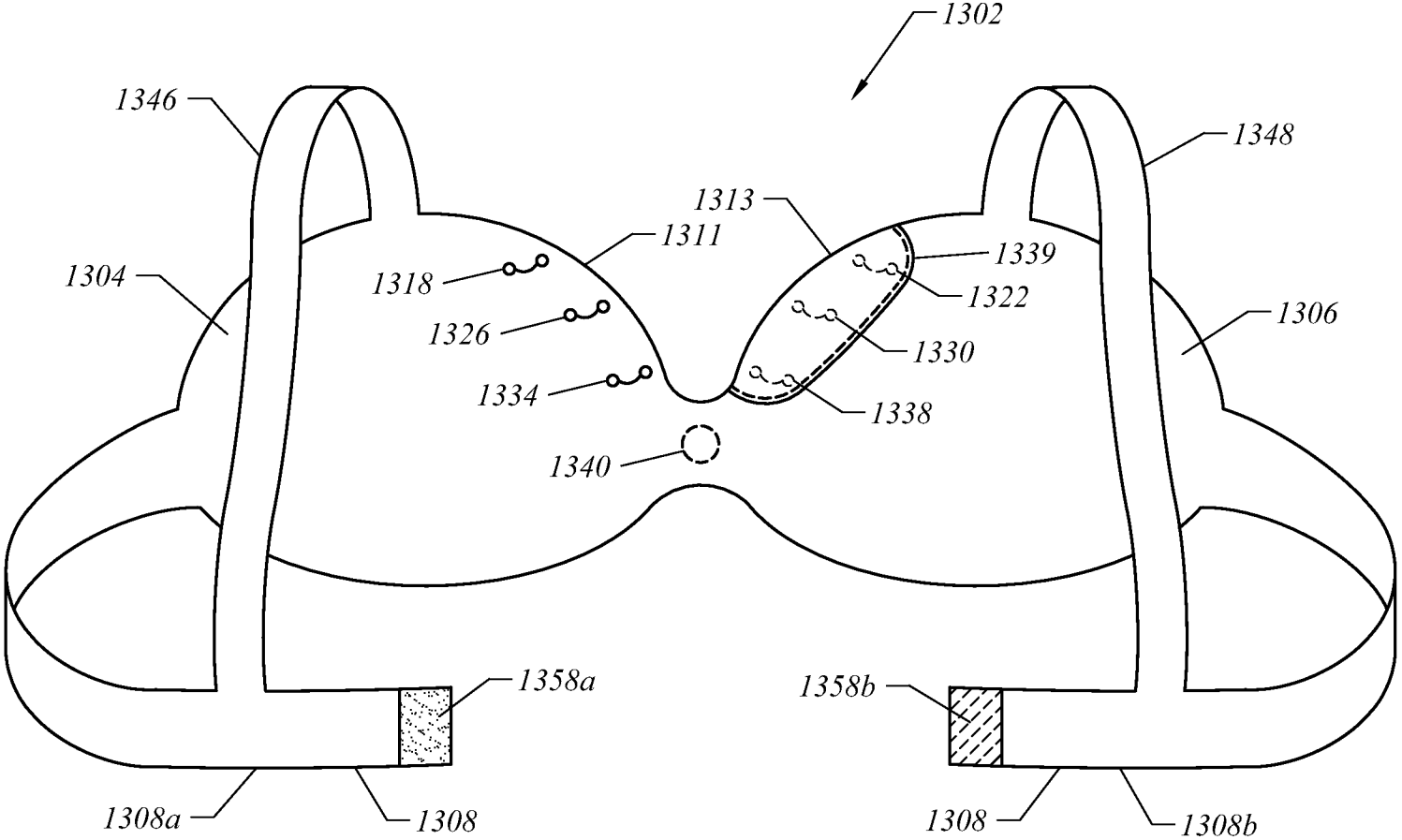
FIG. 13 shows another view of an embodiment of a brassiere, showing loops adjacent the inward edges of the left and right brassiere cups.

Returning now to discussion of the brassiere 502 (see FIG. 5), FIG. 13 shows 1302 another view of an embodiment of a brassiere, showing loops 1318, 1322, 1326, 1330, 1334, and 1338 adjacent the inward edge 1311 of the left brassiere cup and the inward edge 1313 of the right brassiere cup. The loops 1318, 1322, 1326, 1330, 1334, and 1338 are instances of the fasteners or attachment devices 518, 522, 526, 530, 534, and 538. A button 1340 on the front of the brassiere 1302 is shown in dashed outline; it provides a means for securing a bottom portion 642 of a modesty panel 610 (see FIG. 6). FIG. 13 also shows that the support band 1308 includes a fastening arrangement 1358*a*-1358*b*, which may be, for example, a hook and loop arrangement as is known in the art. The brassiere 1302 also includes a strap 1346 between the left brassiere cup 1304 and the support band 1308 and a strap 1348 between the right brassiere cup 1306 and the support band 1308.

As shown in FIG. 13, the support band 1308 includes a left segment 1308*a* coupled with the left brassiere cup, and a right segment 1308*b* coupled with the right brassiere cup. The fastening arrangement 1358*a*-1358*b* can have an unfastened condition and a fastened condition. As shown, the fastening arrangement 1358*a*-1358*b* is configured to fasten the left segment 1308*a* with the right segment 1308*b* when the fastening arrangement is in the fastened condition, and to separate the left segment 1308*a* and the right segment 1308*b* when the fastening arrangement is in the unfastened condition. Typically, but not necessarily, the fastening arrangement 1358*a*-1358*b* is disposed toward a back of the torso of a wearer when the brassiere is in position as an undergarment. The fastening arrangement 1358*a*-1358*b* can thus provide a means for fastening the left segment 1308*a* with the right segment 1308*b*.

FIG. 13 also shows a fastener concealment flap 1339 adjacent the inward edge 1313 of the right brassiere cup 1306. For clarity in showing the loops 1318, 1326, and 1334 in FIG. 13, only the right fastener concealment flap 1339 is shown, but it is understood that embodiments with a fastener concealment flap would have both a right fastener concealment flap adjacent the inward edge 1313 of the right brassiere cup 1306 and a left fastener concealment flap adjacent the inward edge 1311 of the left brassiere cup 1304. The fastener concealment flaps insulate the breasts of the wearer from contact with the fasteners 1322, 1330, and 1338. In this manner, a more comfortable feel to the brassiere is provided. Moreover, the fastener concealment flap may be fabricated from material, such as, for example, satin, to enhance the appearance and/or design of the brassiere when not being worn.

Figure 14:
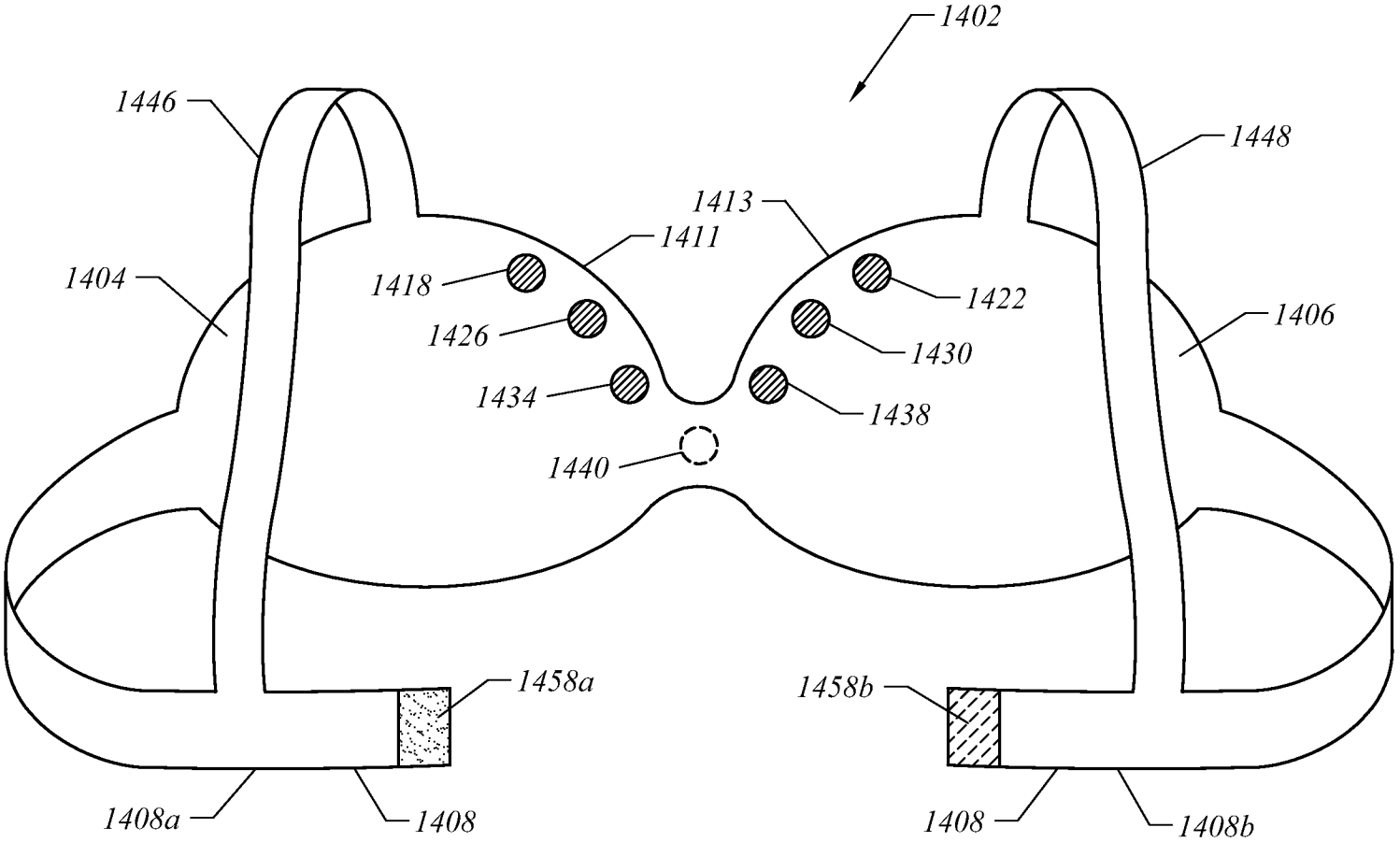
FIG. 14 shows another view of an embodiment of a brassiere, showing loop material adjacent the inward edges of the left and right brassiere cups.

FIG. 14 is similar to FIG. 13 and shows another view of an embodiment of a brassiere. FIG. 14 shows loop material areas 1418, 1422, 1426, 1430, 1434, and 1438 adjacent the inward edge 1411 of the left brassiere cup 1404 and the inward edge 1413 of the right brassiere cup 1406. In an analogous way as described above in connection with FIG. 13, the loops 1418, 1422, 1426, 1430, 1434, and 1438 are instances of the fasteners or attachment devices 518, 522, 526, 530, 534, and 538. A fastener 1440 on the front of the brassiere is shown in dashed outline; it is used to secure the bottom portion 642 (see FIG. 6) of a modesty panel 610 to the brassiere 1402. The fastener may be a button 1440, like the button 1340 of FIG. 13, or may be another kind of fastener, for example, a snap fastener. It should be understood that any appropriate fastener as known in the art may be used. FIG. 14 also shows that the support band 1408 includes a fastening arrangement 1458*a*-1458*b*, which may be, for instance, a hook material and loop material arrangement, for example using a material such as VELCRO. Just as in FIG. 13, the support band 1408 includes a left segment 1408*a* and a right segment 1408*b* that may be fastened or separated depending on the condition of the fastening arrangement 1458*a*-1458*b*.

The brassiere 1402 also includes a strap 1446 between the left brassiere cup 1404 and the support band 1408 and a strap 1448 between the right brassiere cup 1406 and the support band 1408. Although shown as non-intersecting straps, in various embodiments the straps may cross, and even intersect, behind the back of a wearer. It should be appreciated that, although the embodiments of FIGS. 13 and 14 are shown with straps, a modesty panel as described herein may in various embodiments be incorporated into a strapless design.

Figure 16:
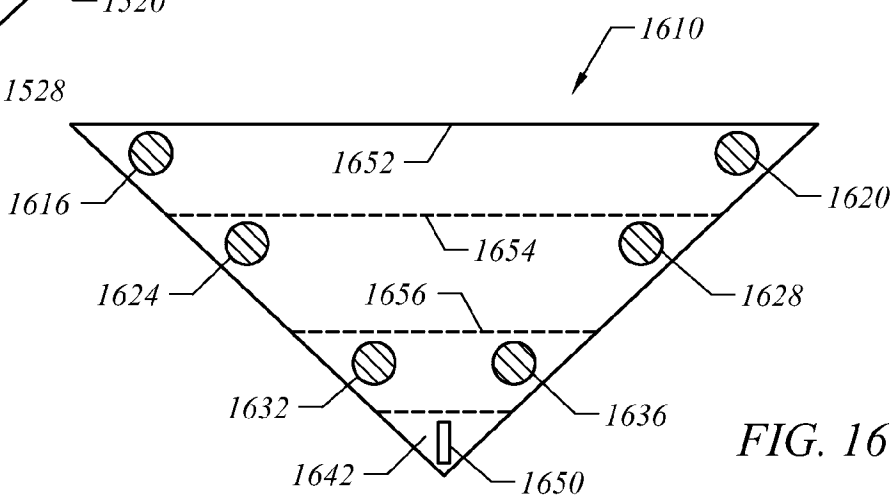
FIG. 16 shows a modesty panel according to an embodiment that includes a set of hook material areas corresponding to the loop material areas adjacent the inward edges of the left and right brassiere cups of FIG. 14.
Figure 15:
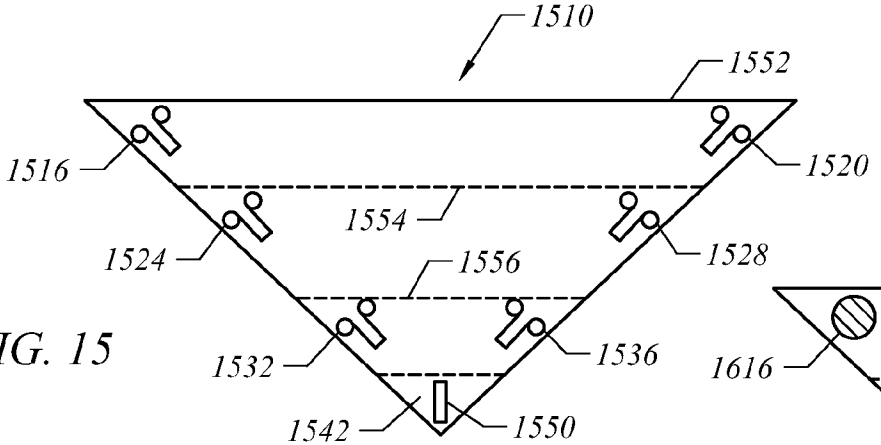
FIG. 15 shows a modesty panel according to an embodiment that includes a set of hooks corresponding to the loops adjacent the inward edges of the left and right brassiere cups of FIG. 13.

As just discussed, FIGS. 13 and 14 show some details of the means for attaching the modesty panel 610 (see FIG. 6) with the brassiere 502 (see FIG. 5). FIGS. 15 and 16 show corresponding details of the attachment areas on the modesty panels 1510 (see FIG. 15) and 1610 (see FIG. 16) respectively. An embodiment of a modesty panel that employs buttons as fasteners is shown in FIG. 17.

Figure 17:
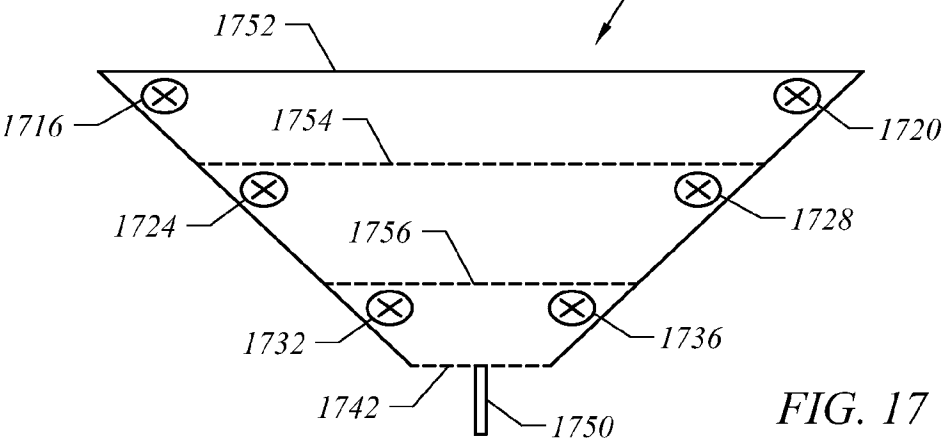
FIG. 17 shows a modesty panel according to an embodiment that includes a set of buttons that would correspond to buttonholes adjacent the inward edges of the left and right brassiere cups.

Thus, FIGS. 15 through 17 show modesty panels similar to that shown in FIG. 6, with specific types of fasteners shown in the attachment areas corresponding to 616, 620, 624, 628, 632, and 636 (see FIG. 6). FIG. 15, for example, shows a modesty panel 1510 that includes a set of hooks 1516, 1520, 1524, 1528, 1532, and 1536 corresponding to the loops 1318, 1322, 1326, 1330, 1334, and 1338, respectively, adjacent the inward edges 1311 and 1313 of the left brassiere cup 1304 and the right brassiere cup 1306 of FIG. 13. A buttonhole 1550 is shown in the bottom region 1542, that is designed to secure the bottom portion of the modesty panel 1510 to the brassiere 802 (see FIG. 8) with for example, a button 840.

FIG. 16 shows a modesty panel 1610 that includes a set of hook material areas 1616, 1620, 1624, 1628, 1632, and 1636 corresponding to the loop material areas 1418, 1422, 1426, 1430, 1434, and 1438, respectively, adjacent the inward edges 1411 and 1413 of the left brassiere cup 1404 and the right brassiere cup 1406 of FIG. 14. As in FIG. 15, a buttonhole 1650 is shown in the bottom region 1642, that is designed to secure the bottom of the modesty panel 1510 to the brassiere 502 (see FIG. 5) with for example, a button 540. It will be appreciated that in either of FIGS. 15 and 16, some other system for fastening the bottom portion 542 of the modesty panel to the brassiere may be employed, for example, a hook fastener or a snap fastener.

It will also be appreciated that some other means may be used for attaching the attachment portions of the modesty panel to the areas adjacent the inward edges of the left and right brassiere cups. For example, and as mentioned above, FIG. 17 shows an embodiment of a modesty panel 1710 that uses buttons 1716, 1720, 1724, 1728, 1732, and 1736 as fasteners, as may be used with a brassiere that included buttonholes. The buttonholes may be arranged adjacent the inward edges of the left and right brassiere cups in a manner similar to the arrangement of the loops 1318, 1322, 1326, 1330, 1334, and 1338 of the brassiere of FIG. 13, or of the areas of loop material 1418, 1422, 1426, 1430, 1434, and 1438 of the brassiere of FIG. 14. Thus, the modesty panel 1710 includes a set of buttons corresponding to buttonholes adjacent the inward edges 511 and 513 (see FIG. 5) of the left brassiere cup 504 and the right brassiere cup 506. It is understood that in yet another embodiment, snap fasteners may be used in place of buttons and buttonholes.

FIG. 17 also shows that a loop, for example, of thread, string or elastic cord, may be connected with the bottom central portion 1742 to define the attachment area 1750. The loop 1750 serves to mate with the button 540 (see FIG. 5) just as a buttonhole 1650 (see FIG. 16) would.

FIGS. 15-17, like FIG. 6, also show schematically that there may be a variety of modesty panels, distinguished by their level of daring. The first level modesty panel has an upper boundary or edge denoted at 1552 in FIG. 15, 1652 in FIG. 16, and 1752 in FIG. 17. A middle level or second level modesty panel may have an upper edge 1554, 1654, or 1754, respectively, and thus may include only the attachment areas below the upper edge, as well as the bottom attachment area 1550, 1650, or 1750. A very low level modesty panel may have an upper edge 1556, 1656, or 1756, respectively, and include the attachment areas below the upper edge, as well as the bottom attachment area in the bottom attachment region 1542, 1642, or 1742, respectively.

In the various embodiments as described herein, all of the modesty panels can be removed easily, as explained above. For example, with the first level modesty panel or a second level modesty panel, if a woman wants to go to a casual setting after work, all she has to do is remove the modesty panel from the brassiere and an outer garment can reveal cleavage that was covered. Alternatively, she can replace the modesty panel with a different modesty panel for a different level of modesty or daring. There would be no need to remove the outer garment to remove or replace the modesty panel. Moreover, there is no additional "bulk" from another undergarment that might have been worn to conceal the cleavage. Furthermore, due to its manner of attachment to the brassiere, particularly at the bottom of the modesty panel, it is held securely in place while in use.

The instant disclosure is provided to explain in an enabling fashion the best modes of making and using various embodiments in accordance with the present invention. The disclosure is further offered to enhance an understanding and appreciation for the invention principles and advantages thereof, rather than to limit in any manner the invention. While the preferred embodiments of the invention are illustrated and described here, it is clear that the invention is not so limited. Numerous modifications, changes, variations, substitutions, and equivalents will occur to those skilled in the art having the benefit of this disclosure without departing from the spirit and scope of the present invention as defined by the following claims.

It is understood that the use of relational terms, if any, such as first and second, up and down, and the like are used solely to distinguish one from another entity or action without necessarily requiring or implying any actual such relationship or order between such entities or actions.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) was chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitably entitled.

What is claimed is:

1. A brassiere for concealing the cleavage between the breasts of a wearer, comprising:

a left cup and a right cup for receiving the breasts, each cup having an inward edge proximate the cleavage and an outward edge disposed oppositely thereto;

a lower central portion connecting the left cup and the right cup below the cleavage, the lower central portion having an inside face and an outside face relative to the wearer;

a modesty panel spanning at least the gap between the inward edges of the left and right cups and configured to cover at least a portion of the cleavage, the modesty panel having a bottom central portion under lapping the lower central portion and extending sufficiently to, at least partially, wrap the outside face;

a first means for fastening to removably connect the modesty panel to the left cup and the right cup;

a second means for fastening to removably connect the bottom central portion of the modesty panel to the outside face of the lower central portion; and a means for securing the brassiere in place on the body of the wearer;

whereby, the first means for fastening holds the modesty panel in place to at least partially cover the cleavage and the second means for fastening firmly secures the modesty panel while providing downward tension for fastener interlocking and fabric smoothing purposes.

2. The brassiere of claim 1, wherein the first means for fastening comprises hooks and loops fashioned from wire material.

3. The brassiere of claim 1, wherein the first means for fastening comprises hook and loop material.

4. The brassiere of claim 1, wherein the first means for fastening comprises buttons and button holes.

5. The brassiere of claim 1, wherein the second means for fastening comprises any one of a button and button hole, a hook and loop or a snap fastener.

6. The brassiere of claim 1, wherein the means for securing the brassiere comprises a support band encircling the body and connecting to the outward edges of the left and right cups, said support band having a separation into two parts wherein a third means for fastening removably connects the parts at the separation.

7. The brassiere of claim 6, wherein the means for securing the brassiere further comprises left and right shoulder straps, the left shoulder strap adjustably connecting between the left cup and the support band and the right shoulder strap adjustably connecting between the right cup and the support band.

8. The brassiere of claim 6, wherein the third means for fastening is selected from the group of fasteners consisting of hooks and loops fashioned from wire material, hooks and loops fashioned from fabric material and snaps.

9. The brassiere of claim 1, further comprising left and right fastener concealment flaps attached proximate the inward edges of the left and right cups respectively, the fastener concealment flaps insulating the first means for fastening from abrasive contact with the breasts.

10. A brassiere system for concealing the cleavage between the breasts of a wearer, comprising:

a left cup and a right cup for receiving the breasts, each cup having an inward edge proximate the cleavage and an outward edge disposed oppositely thereto;

a lower central portion connecting the left cup and the right cup below the cleavage, the lower central portion having an inside face and an outside face relative to the wearer;

a plurality of modesty panels, usable separately, each said panel structured to span at least a gap between the inward edges of the left and right cups, each said panel configured to cover at least a portion of the cleavage, each said panel having a bottom central portion under lapping the lower central portion and extending to, at least partially, wrap the outside face;

a first means for fastening to removably connect each modesty panel to the left cup and the right cup;

a second means for fastening to removably connect the bottom central portion of each modesty panel to the outside face of the lower central portion; and a means for securing the brassiere in place on the body of the wearer;

whereby, the first means for fastening holds a selectively worn modesty panel in place to at least partially cover the cleavage and the second means for fastening firmly secures each said selectively worm modesty panel while providing downward tension for fastener interlocking and fabric smoothing purposes.

11. The brassiere system of claim 10, wherein the plurality of modesty panels comprises at least three levels of daring, said levels defined by showing cleavage corresponding to a position in the upper half of the brassiere, a position at the mid-section of the brassiere, and a position in the lower half of the brassiere.

12. The brassiere system of claim 10, wherein at least two of the plurality of modesty panels are selected from different materials, said materials selected from the group consisting of, at least in part, lace, silk, cotton, polyester and stretch.

13. The brassiere system of claim 10, wherein the first means for fastening comprises at least one of hooks and loops fashioned from wire material, hook and loop material, buttons and button holes, snaps, or any combination thereof.

14. The brassiere system of claim 10, wherein the second means for fastening comprises any one of a button and button hole, a hook and loop or a snap fastener.

15. The brassiere system of claim 10, wherein the means for securing the brassiere comprises a support band encircling the body and connected to the outward edges of the left and right cups, said support band having a separation into two parts wherein a third means for fastening removably connects the parts at the separation.

16. The brassiere system of claim 10, further comprising left and right fastener concealment flaps attached proximate the inward edges of the left and right cups, the fastener concealment flaps insulating the first means for fastening from abrasive contact with the breasts.

17. A method of changing cleavage reveal while remaining essentially dressed, comprising the steps:

providing a brassiere having a left cup and a right cup for receiving the breasts of a wearer, each cup having an inward edge proximate the cleavage and an outward edge disposed oppositely thereto; a lower central portion connecting the left cup and the right cup below the cleavage, the lower central portion having an inside face and an outside face relative to the wearer; a modesty panel spanning the gap between the inward edges of the left and right cups and configured to cover at least a portion of the cleavage, the modesty panel having a bottom central portion under lapping the lower central portion and extending sufficiently to, at least partially, wrap the outside face; a first means for fastening to removably connect the modesty panel to the left cup and the right cup, said first means for fastening disengageable in an essentially upward direction; a second means for fastening to removably connect the bottom central portion of the modesty panel to the outside face of the lower central portion; and a means for securing the brassiere in place on the body of the wearer;

disengaging the second means for fastening;

hand-gripping an exposed top portion of the modesty panel; and pulling the modesty panel upwardly to disengage the first means for fastening;

whereby the modesty panel is thereby removed from the brassiere-in-place to reveal the cleavage and change to a lower level of modesty.

18. The method of claim 17, wherein the first means for fastening comprises hooks and loops fashioned from wire material, the loops attached to the left and right cups, the hooks attached to the modesty panel with mouths opening downwardly.

19. The method claim 17, wherein the second means for fastening comprises a button and button hole or a hook and loop, the button hole or the hook in position for convenient access with the brassiere-in-place.

20. The method of claim 17, further comprising the additional steps:

providing a second modesty panel with a different level of modesty;

engaging the first means for fastening therewith;

hand-gripping the bottom central portion of the second modesty panel; and pulling the second modesty panel downwardly to underlap the lower central portion and engage the second means for fastening;

whereby the brassiere configuration is restored to a different level of modesty.

* * * * *